US005890436A

United States Patent [19]

Thompson

[11] Patent Number: 5,890,436

[45] **Date of Patent: *Apr. 6, 1999**

[54] SAFETY LOCKING SYSTEM FOR AIR-OPERATED TILT TABLES

[76] Inventor: Ronald J. Thompson, 3101 Mill Pond Dr. Apt3B, Holland, Mich. 49424

[ * ] Notice: The term of this patent shall not extend beyond the expiration date of Pat. No. 5,431,112.

[21] Appl. No.: 743,830

[22] Filed: Nov. 5, 1996

Related U.S. Application Data

[63] Continuation of Ser. No. 500,705, Jul. 11, 1995, Pat. No. 5,572,933, which is a continuation-in-part of Ser. No. 220, 749, Mar. 31, 1994, Pat. No. 5,431,112.

[51] Int. Cl.[6] ..... A47F 5/12

[52] U.S. Cl. ..... 108/7

[58] Field of Search ..... 108/7, 6, 1; 248/396, 248/394, 397; 5/615, 614, 634; 297/328, DIG. 8, 284.11, 313

[56] References Cited

U.S. PATENT DOCUMENTS

| | | | |
|---|---|---|---|
| 743,344 | 11/1903 | Souder et al. | 108/6 |
| 1,859,456 | 5/1932 | Nestler | 108/2 |
| 3,004,812 | 10/1961 | Miller | 5/614 |
| 3,198,575 | 8/1965 | Hawkins | 297/328 |
| 3,213,809 | 10/1965 | Kritske | 108/2 |
| 3,358,620 | 12/1967 | Parigi | 108/6 |
| 3,599,963 | 8/1971 | Grover | 5/614 |
| 3,638,584 | 2/1972 | Cisler et al. | 108/6 |
| 3,825,244 | 7/1974 | Bauer | 267/124 |
| 3,874,309 | 4/1975 | Cowley | 108/2 |
| 4,180,002 | 12/1979 | Huempfner | 108/6 |
| 4,365,561 | 12/1982 | Tellier et al. | 108/7 |
| 4,462,579 | 7/1984 | Satake | 108/7 |
| 4,605,189 | 8/1986 | Bruneau | 248/162.1 |
| 4,734,945 | 4/1988 | Wright | 5/11 |
| 4,839,932 | 6/1989 | Williamson | 5/615 |
| 5,005,669 | 4/1991 | Umebara et al. | 108/6 |
| 5,014,378 | 5/1991 | Sato | 5/453 |
| 5,131,333 | 7/1992 | Karasawa et al. | 108/7 |
| 5,243,921 | 9/1993 | Kruse et al. | 100/147 |

FOREIGN PATENT DOCUMENTS

| | | | |
|---|---|---|---|
| 75842 | 4/1984 | Japan | 297/284.11 |
| 230833 | 12/1984 | Japan | 297/284.11 |

*Primary Examiner*—Peter M. Cuomo
*Assistant Examiner*—Janet M. Wilkens
*Attorney, Agent, or Firm*—Waters & Morse, PC

[57] ABSTRACT

A tiltable table has a pneumatic actuator and a locking system for establishing and maintaining a table position. The locking system is operated by an air cylinder that engages a dog with a ratchet plate secured to the table. The ratchet permits the table to be raised but not lowered while locked. The ratchet must be unlocked before the table can be lowered. The dog is spring-biased to locking position, and is air-operated for release against the action of the biasing spring. On lowering the table, air from the actuator can be used to unlock the ratchet. The air can be permitted to escape through a restriction orifice at a slow enough rate to maintain sufficient air pressure to keep the locking system disengaged, but sudden release of all the air pressure will again permit the spring to re-lock the system to prevent a downward slamming of the table surface.

10 Claims, 4 Drawing Sheets

SAFETY LOCKING SYSTEM FOR AIR-OPERATED TILT TABLES

CROSS REFERENCE TO RELATED APPLICATIONS

This application is a continuation of applicant's patent application Ser. No. 08/500,705, filed Jul. 11, 1995, now U.S. Pat. No. 5,572,933, issued Nov. 12, 1996, the disclosure of which is incorporated here by reference, which is a continuation-in-part of applicant's then patent application Ser. No. 08/220,749, filed Mar. 31, 1994, now U.S. Pat. No. 5,431,112, issued Jul. 11, 1995, the disclosure of which is incorporated here by reference.

RELATED FIELD

This invention relates to the actuating system for power-operated tilt tables.

BACKGROUND OF THE INVENTION

Many types of equipment involve inclinable table surfaces. Industrial operations often require objects to be tilted or elevated, and hospital equipment must frequently be capable of supporting a patient in an inclined position. Considerable weight may have to be supported in both cases, which has led to power-actuated systems subject to the control of an operator. Air (pneumatic) and liquid (hydraulic) systems for actuating and positioning the moveable table surface are frequently used, depending on the requirements of the particular application. A general term covering both systems would be "fluid"-operated. Compressed air provides quicker action, and less leakage problem, but is compressible. Hydraulic operation is therefore more appropriate where positive positioning by the actuator alone is required. The greater simplicity of the pneumatic system provides an inducement to include some sort of positive positioning for the air-operated actuator. The addition of fail-safe characteristics also increases the number of applications that can utilize the advantage of the pneumatic system. Rupture of an air conduit or air bag actuator is then no longer a hazard.

SUMMARY OF THE INVENTION

The preferred form of the present invention, because of its simplicity, utilizes an accordion-type air bag as an actuator. A tiltable table panel is pivotally mounted on a convenient base structure, and the air bag is adapted to apply force between these components. An arcuate ratchet plate is preferably mounted on the table panel coaxially with the table pivot. A ratchet dog is slidably supported in a guideway carried by the base structure in position to move into and out of engagement with the ratchet plate to lock the position of the tiltable panel. An air cylinder, also mounted on the base structure, has a piston rod connected to the dog to position it. A spring in the cylinder biases the piston to urge the dog to locking position, and an air inlet in the cylinder is located so that air pressure is operable to unlock the dog. This air inlet is in parallel with the exhaust from the air bag, and both are under the control of a selector valve. Exhaust from the air bag is directed through a restricted orifice to slow the deflation of the air bag when the selector valve is set to provide an exhaust passage (corresponding to lowering the table). This provides enough remaining pressure in the air conduit from the air bag to overcome the biasing spring to keep the dog unlocked during the period in which the table is returning to a horizontal position. A blow out in the air bag, or a rupture of air conduit, will so reduce the line pressure as to re-lock the dog to the ratchet plate under the action of the biasing spring. The table will then be prevented from slamming down under the weight it may be carrying.

DESCRIPTION OF THE PREFERRED EMBODIMENTS

Figure 1:
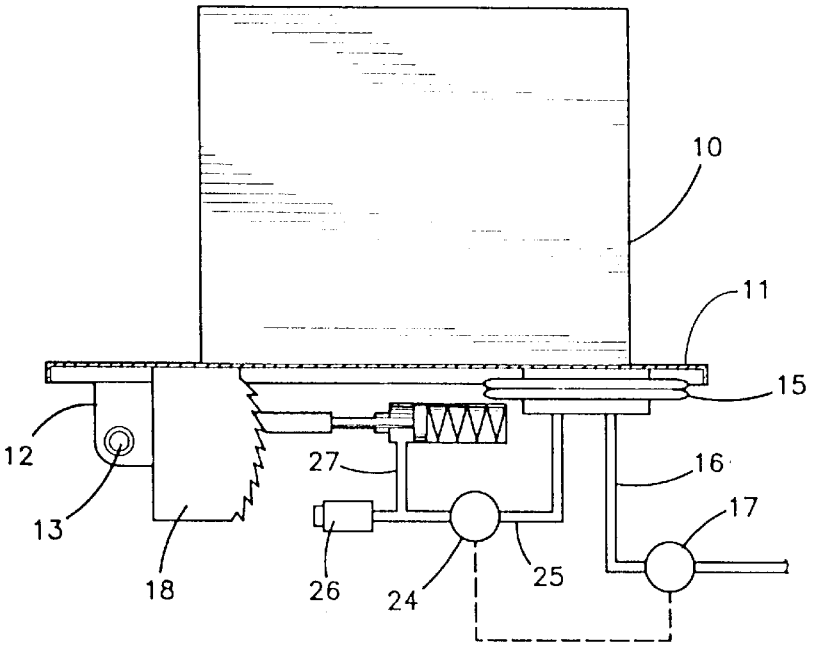
FIG. 1 is a schematic view showing the condition of the system prior to the actuation which would induce tilting.
Figure 2:
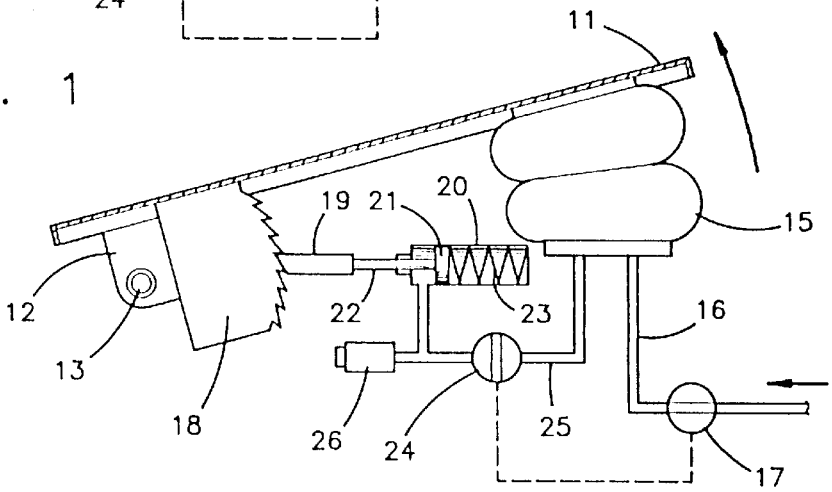
FIG. 2 is a schematic view of the same components that appear in FIG. 1, but in the position corresponding to movement of the table surface to an inclined position.

Referring to FIGS. 1–4, an object of any description is indicated at 10, representing a weight carried by the tiltable table surface 11. This table panel includes an arm 12 extending to a pivotal connection 13 providing a fulcrum on the base structure 14 shown in FIG. 5. A safety locking system according to the invention is connected between the tiltable table surface 11 and the base structure 14, and includes first and second members that may be configured as a ratchet plate and a cooperating dog, for example. An accordion-type air bag 15 is mounted on the base structure, and acts against the underside of the table panel 11 when it is necessary to move it to an inclined position. Compressed air is admitted to the air bag through the conduit 16 under the control of the valve 17.

A ratchet plate 18 is secured to the table panel 11, with the arcuate notched periphery concentric with the axis of the pivot 13. The inclination of the notches of the ratchet plate is selected to provide a positive lock against a return of the table surface to the horizontal position when the dog 19 is in the locking position shown in FIG. 2. A cylinder 20, also mounted on the base structure, carries a piston 21 with a piston rod 22 extending to a connection with the dog 19. The compression spring 23 biases the dog 19 into the locking position shown in FIG. 2, in the absence of significant air pressure in the cylinder in the portion to the left of the piston 21 shown in FIG. 2. As the valve 17 is set to admit air through the conduit 16 to inflate the air bag 15, the upward tilting movement of the table is accompanied by a cam action (due to the incline of the teeth of the ratchet) that moves the dog 19 to the right against the action of the spring 23. This action continues during the selected degree of extension of the air bag 15.

Figure 3:
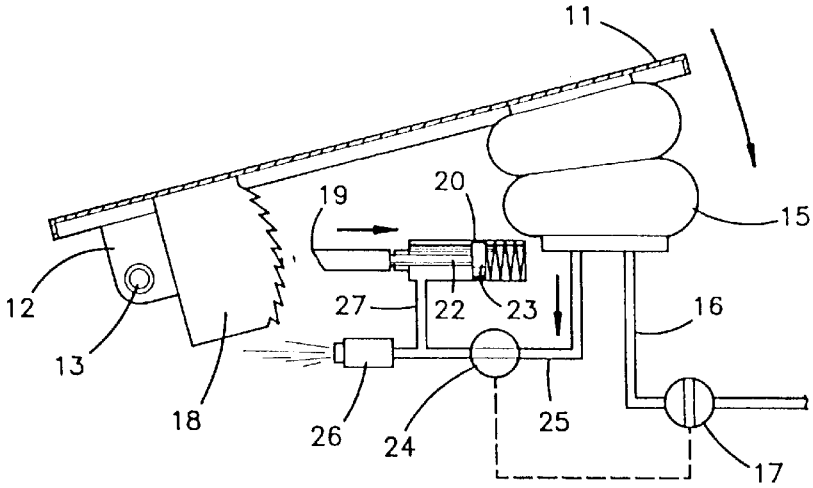
FIG. 3 is a view of the same components as appear in FIGS. 1 and 2, showing the condition of the components corresponding to a gradual lowering of the table.
Figure 4:
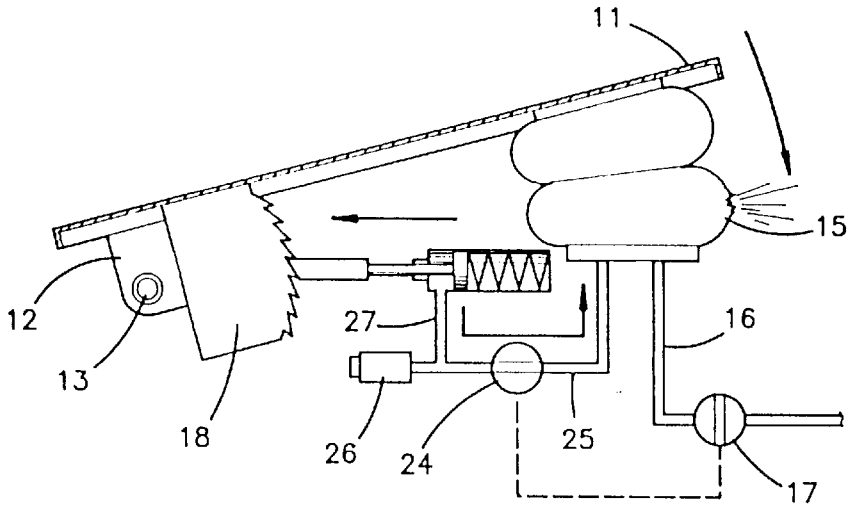
FIG. 4 is a view of the same components as appearing in FIGS. 1–3, but in the position corresponding to a rupture of an air line or the air bag actuator.

When it becomes necessary to lower the table back toward the horizontal position, the valve 17 is first checked to be sure that it is in closed position. It may well have been placed there previously, on establishment of a desired degree of tilt to the table panel. The valve 24 is then opened, permitting air to flow out through the conduit 25 from the air bag 15, and be discharged through the restricted orifice unit 26. The effect of this restricted discharge is to maintain sufficient pressure in the left end of the cylinder 20 to overcome the biasing action of the spring 23, and permit the dog 19 to withdraw from the ratchet plate 18. The exhaust pressure conditions in the air bag 15 are maintained within the cylinder 20 through the connection 27, which has the effect of placing the left side of the cylinder in parallel with the conditions in the air bag. This condition is illustrated in FIG. 3, corresponding to the gradual lowering of the table panel 11 toward a horizontal position. If the air bag 15 or the pressure conduits rupture, however, a fail-safe condition immediately sets in. Pressure in the air line 27 is suddenly reduced to the point that the action of the spring 23 instantly moves the dog 19 into the locking position shown in FIG. 4. The system will remain in this condition until the air pressure conditions are reestablished. The result of this arrangement is to prevent the table panel 11 from slamming down under the effect of the weight 10, and causing damage or injury. For convenience, the valves 17 and 24 may be combined into a single unit that can be placed in positions corresponding to the illustrated conditions.

Figure 6:
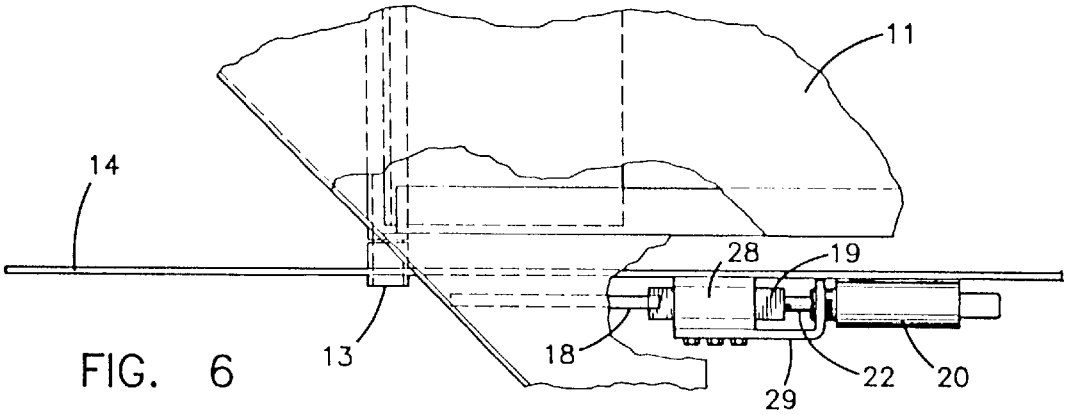
FIG. 6 is a top view of the mechanism appearing in FIG. 5.
Figure 5:
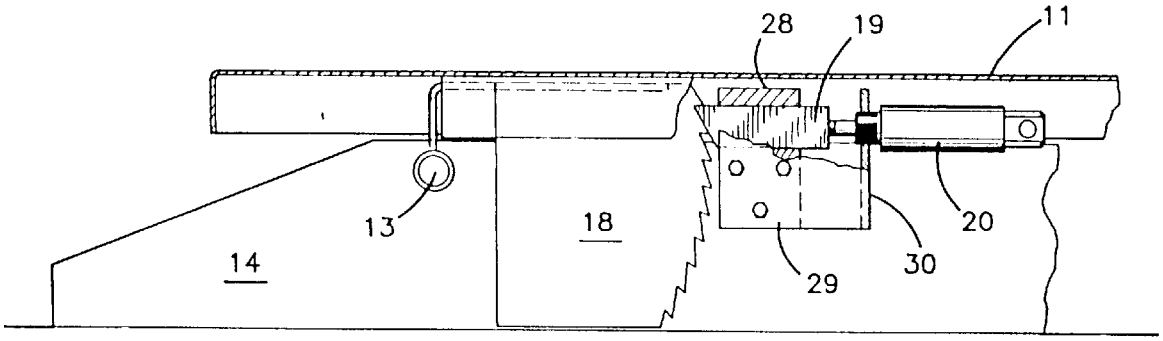
FIG. 5 is a side elevation of the locking mechanism shown in the locked position.

Referring to FIGS. 5 & 6, the dog 19 is slidably supported in a guideway structure 28 carried by the bracket 29 mounted on the base 14. The bracket also has a flange 30 on which the cylinder 20 is mounted. The mounting of this locking system will vary in detail with the particular base structure on which the tilting table is supported. It should be noted that a natural biasing system is continually present urging the table panel to a horizontal position in opposition to the actuating system. This is due to the effect of the weight on the table panel, and the weight of the panel itself. These forces will normally be eccentric to the pivotal mounting of the table.

A second embodiment of the invention is shown in FIGS. 7–10. Parts that are the same as in previous embodiments are given the same numbers. In this embodiment, the valves are combined into a single unit preferably in the form of a spool or shuttle valve 40. Shuttle valve 40 is manually actuatable by an actuating button 42 that shifts the valve between the positions shown in FIG. 7 and the position shown in FIG. 9. When in the position shown in FIG. 7, valve 40 is shifted to the right so that an outlet 44 of pneumatic cylinder 20 is vented through passage 44 in the valve to exhaust conduit 45 which leads to atmosphere. A source of compressed air 48 is connected to passage 46 in valve 40 and this leads to conduit 50 which in turn is connected to air spring 15. A pressure regulator 52 and flow restricter valve 54 (both shown schematically) regulate the air pressure and rate of air flow to and from the air spring.

Figure 7:
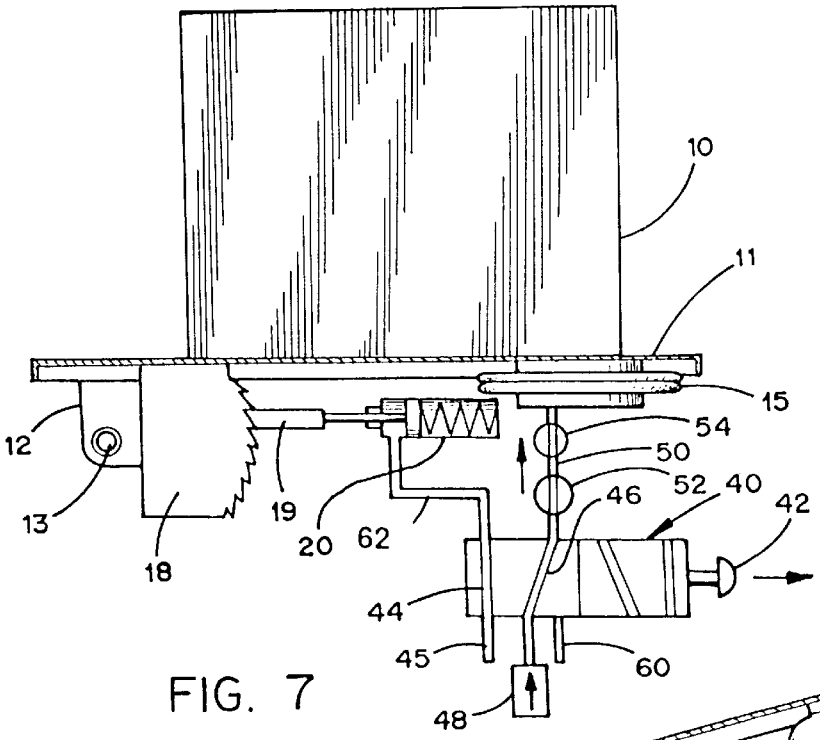
FIG. 7 is a schematic view of a second embodiment showing the condition of the system prior to the actuation which would induce tilting.
Figure 8:
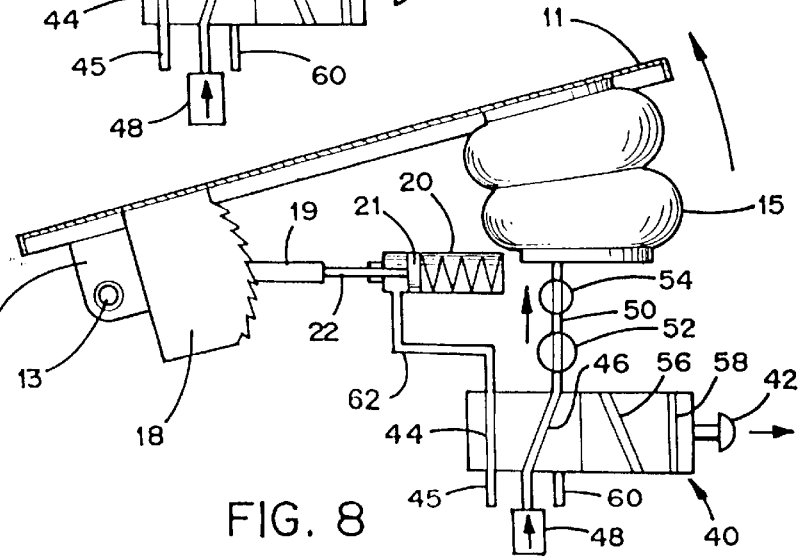
FIG. 8 is a schematic view of the same components that appear in FIG. 7, but in the position corresponding to movement of the table surface to an inclined position.

When the valve is positioned to the right, as shown in FIG. 7, air pressure is directed to the air spring to inflate the air spring, while no air pressure is directed to the pneumatic cylinder 20, thus leaving the ratchet latch between dog 19 and ratchet plate 18 locked. This permits the table to be raised, as shown in FIG. 8 but prevents the table from lowering.

Figure 9:
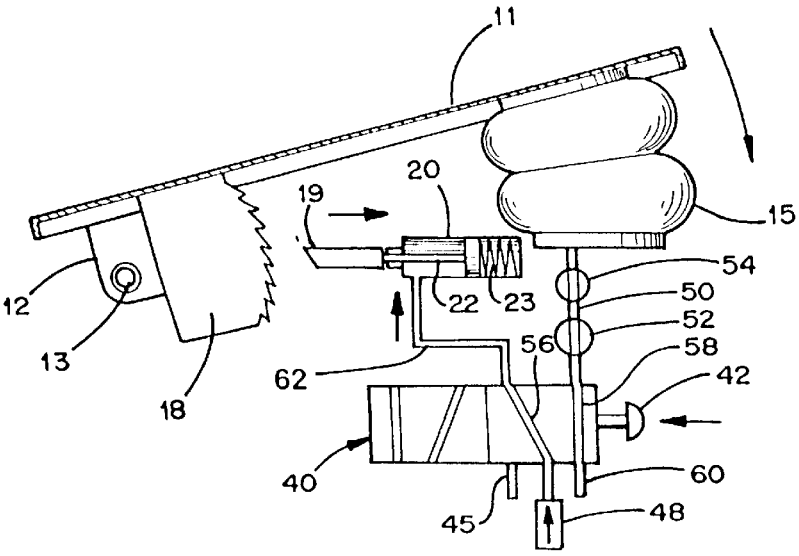
FIG. 9 is a view of the same components as appear in FIGS. 7 and 8, showing the condition of the components corresponding to a gradual lowering of the table.

When the actuating button 42 or spool is shifted to the left, as shown in FIG. 9, passage 56 in the right hand side of the valve connects the pressurized air supply to conduit 62 leading to cylinder 20. This shifts piston 20 to the right, compressing spring 23 and retracting or releasing dog 19 from ratchet plate 18. At the same time, passage 58 in the right hand section of the valve connects conduit 50 leading from air spring 15 to exhaust conduit 60 leading to atmosphere. This releases the pressure in air bag 15 and permits a gradual deflation of the air bag, with the flow being restricted by flow restricter 54.

Figure 10:
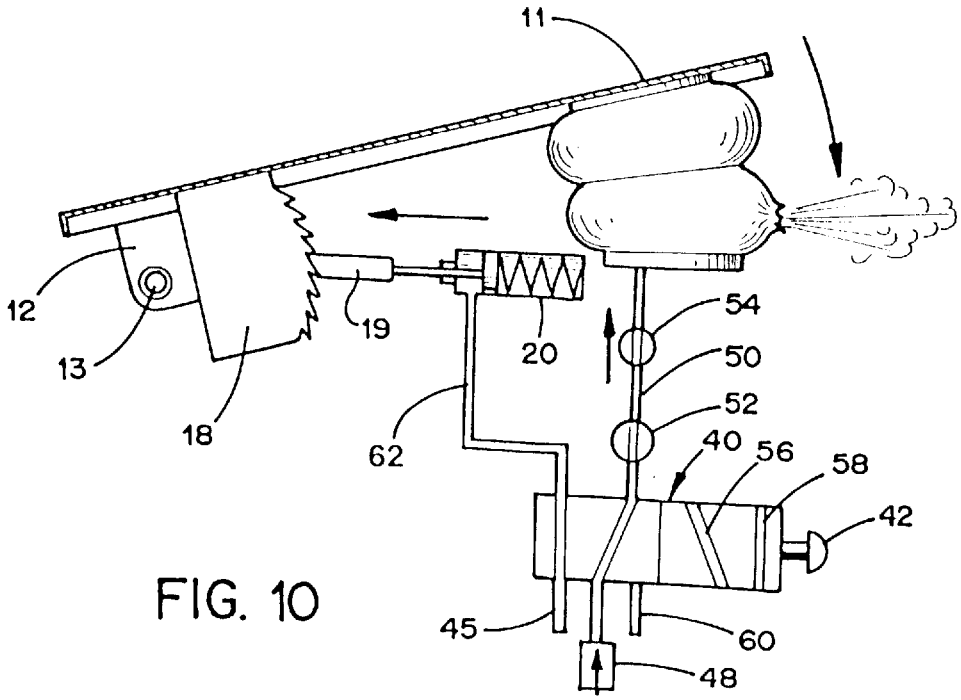
FIG. 10 is a view of the same components as appearing in FIGS. 7–9, but in the position corresponding to a rupture of an air line or the air bag actuator.

In most situations, it has been found that the air bag fails at the time that air pressure is being introduced into the air bag, which occurs during inflation of the bag. As shown in FIG. 10, if the air spring or inlet air conduit fails during inflation of the bag, dog 19 is still engaged in ratchet plate 18 so that the locking device continues to hold the table 11 in position, even though the air pressure circuit fails.

In operation, the spool valve is first manually moved to the right so that the air spring can be inflated, and then the spool valve is moved to the left in order to lower the table.

The foregoing is exemplary of the preferred practice of the present invention. However, various changes and modifications may be made in the arrangements and details of construction of the embodiments disclosed herein without departing from the spirit and scope of the present invention, which is defined in the appended claims.

I claim:

1. A locking system for a tilt table, comprising:

a base;

a table top, said table top being pivotally connected with the base to pivot between a generally horizontal, lowered position and an inclined, raised position;

a table actuator, said table actuator having a lift mode, having a lower mode, and being operatively connected with the table top to pivot the table top to the raised position when the table actuator is in the lift mode, and to pivot the table top to the lowered position when the table actuator is in the lower mode;

a first member connected with the table top to move in a first direction when the actuator pivots said table top from the lowered to the raised positions, and to move in a second direction, opposite to the first direction, when the actuator pivots said table top from the raised position to the lowered position;

a cooperating second member operatively connected with the base and adapted to engage said first member to resist said first member moving in said second direction, said second member having a locked position in which said second member engages said first member to resist said first member moving in said second direction, and having an unlocked position in which said second member disengages said first member so movement of said first member in each of said first and said second directions is unresisted by said second member; and a latch actuator operatively connected with said second member to place said second member in each of said locked and said unlocked positions.

2. The locking system defined in claim 1 further including a biasing member operatively connected with said second member to bias said second member toward said locked position.

3. The locking system defined in claim 2 wherein said first member is a ratchet plate with a notched periphery and wherein said second member is a cooperating dog adapted to engage said notched periphery.

4. The locking system defined in claim 3 wherein said latch actuator is operatively connected with the table actuator to place said second member in said locked position when the table actuator is in the lift mode and to place said second member in said unlocked position when the table actuator is in the lower mode.

5. The locking system defined in claim 1 wherein said first member is a ratchet plate with a notched periphery and wherein said second member is a cooperating dog adapted to engage said notched periphery.

6. The locking system defined in claim 1 wherein said latch actuator is operatively connected with the table actuator to place said second member in said locked position when the table actuator is in the lift mode and to place said second member in said unlocked position when the table actuator is in the lower mode.

7. A locking system for a tilt table, comprising:

a base;

a table top connected with the base;

a pivot interposed between the base and the table top so the table top pivots between a generally horizontal, lowered position and an inclined, raised position;

an actuator, the actuator having a lift mode and having a lower mode, the actuator being operatively connected with the table top to move the table top to the raised position when the actuator is in the lift mode, and to move the table top to the lowered position when the actuator is in the lower mode;

a releasable latch operatively connected with the table top, said latch having an engaged position in which said latch resists movement of the table top from the raised position to the lowered position, and having a released position in which movement of the table top toward either of the raised and the lowered positions is unresisted by said latch;

a latch actuator operatively connected with said latch to move said latch between said engaged and said released positions; and a biasing member operatively connected with said latch to bias said latch toward said engaged position.

8. The locking system defined in claim 7 wherein said releasable latch includes a ratchet plate with a notched periphery and a cooperating dog adapted to engage said notched periphery.

9. The locking system defined in claim 8 wherein said latch actuator is operatively connected with the table actuator to place said releasable latch in said engaged position when the table actuator is in the lift mode and to place said releasable latch in said released position when the table actuator is in the lower mode.

10. The locking system defined in claim 7 wherein said latch actuator is operatively connected with the table actuator to place said releasable latch in said engaged position when the table actuator is in the lift mode and to place said releasable latch in said released position when the table actuator is in the lower mode.

* * * * *